United States Patent [19]

Hickson

[11] 4,272,018

[45] Jun. 9, 1981

[54] APPARATUS AND METHOD FOR SPRAYING REFRACTORY MATERIAL

[75] Inventor: Richard W. Hickson, Lake Village, Ind.

[73] Assignee: Southern Refractories, Inc., Chicago, Ill.

[21] Appl. No.: 930,985

[22] Filed: Aug. 4, 1978

[51] Int. Cl.[3] ..... B05B 13/04; C21B 7/06

[52] U.S. Cl. ..... 239/8; 239/226; 239/229

[58] Field of Search ..... 239/227, 229, 1, 8–11, 239/225, 226; 266/281; 118/306, 317, 318, 323; 427/236; 134/167 R, 168 R, 172, 180, 181

[56] References Cited

U.S. PATENT DOCUMENTS

| | | | |
|---|---|---|---|
| 479,249 | 7/1892 | Cuthbert | 239/227 |
| 691,419 | 1/1902 | Vandervoort | 239/227 |
| 2,082,330 | 6/1937 | Trede et al. | 239/227 |
| 2,979,271 | 4/1961 | Boyden | 239/227 X |
| 3,001,534 | 9/1961 | Grant, Jr. | 134/167 R |
| 3,058,667 | 10/1962 | Weiss | 239/227 |
| 3,092,329 | 6/1963 | Twaroch | 239/227 |
| 3,420,444 | 1/1969 | Ajnefors | 239/227 |
| 3,460,988 | 8/1969 | Kennedy, Jr. et al. | 239/227 X |
| 3,797,745 | 3/1974 | Haus | 239/227 |
| 3,799,445 | 3/1974 | Marino | 239/227 X |
| 3,874,594 | 4/1975 | Hatley | 239/227 |
| 3,902,669 | 9/1975 | Keibler | 239/227 |
| 4,099,708 | 7/1978 | Morris et al. | 239/227 X |

FOREIGN PATENT DOCUMENTS

| | | | |
|---|---|---|---|
| 569925 | 2/1959 | Canada | 118/317 |

*Primary Examiner*—Andres Kashnikow

*Attorney, Agent, or Firm*—Neuman, Williams, Anderson & Olson

[57] ABSTRACT

A portable apparatus for spraying refractory material on the interior surface of refractory bodies having a fixed top element and a rotating bottom element. A downwardly depending adjustable spray nozzle which is angularly positionable to direct refractory material through a 90° arc bounded by a line running through the base of the nozzle perpendicular to the vertical axis of the apparatus and the vertical axis of the apparatus is mounted on the bottom element. In operation, the apparatus is moved through the length of the vessel while the bottom element is rotated and the angular position of the spray nozzle is adjusted to evenly spray refractory material on the interior surfaces of the vessel. Through rotation and adjustment, the spray may be downwardly and/or outwardly directed anywhere in a hemisphere bounded by a plane running through the base of the nozzle perpendicular to the vertical axis of the apparatus. The spray may also be directed by selective rotation of the bottom element and selective adjustment of the nozzle to concentrate spray at a particular area in the vessel.

8 Claims, 3 Drawing Figures

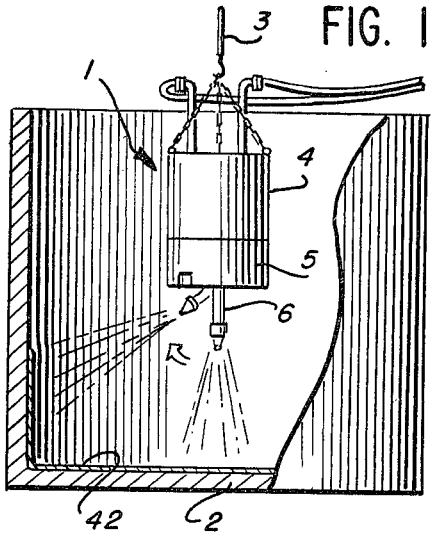
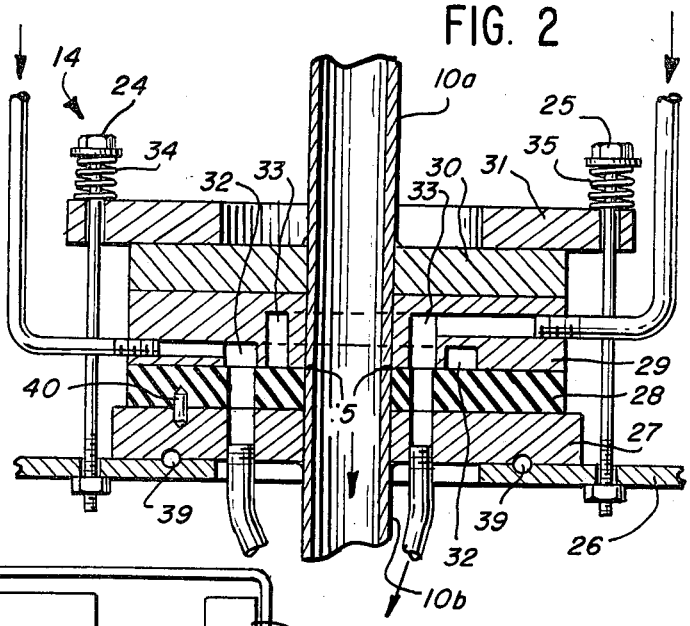
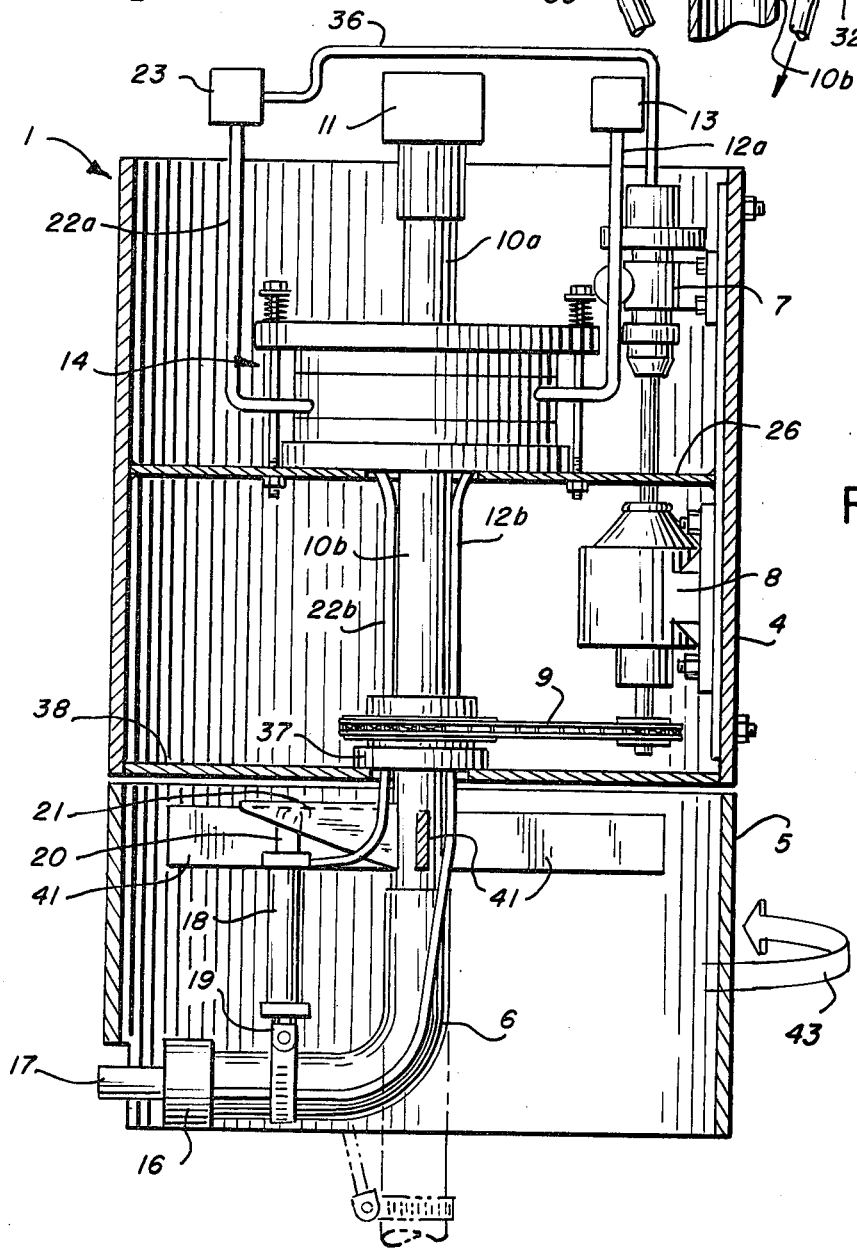
FIG. 3

APPARATUS AND METHOD FOR SPRAYING REFRACTORY MATERIAL

BACKGROUND OF THE INVENTION

In industries where hot metals are transported, stored, or refined, deep-walled refractory bodies such as furnaces, storage vessels and ladles are used to hold hot molten metal during processing. The contact of the hot metal with the refractory body causes, without protection of the contact surfaces, a rapid deterioration, corrosion, and eventually destruction of the body.

In order to prolong the useful life of a refractory body, it is usual in the metal fabrication field to spray a suitable refractory material onto the interior surfaces of the body to coat those surfaces, the refractory material being designed to insulate said surfaces from hot molten metal. The refractory material is commonly dried and powdered, and may be mixed with a suitable wetting agent, such as water, to facilitate spraying. The treatment of a refractory body with such material only protects the body for a finite length of time; therefore, regular applications of the material are required to insure protection of the interior surfaces of the body.

Because of the expense involved in repeated applications, it is essential to maximize the period over which an application of refractory material will provide protection for the refractory body. To insure maximum duration between refractory applications it is critical that the refractory material be applied evenly over the interior of the body. Any lumping or uneven application of the material will render it susceptible to chipping or faulting. Unfortunately, when the material chips, a large portion is often carried away, exposing a section of the interior surface of the body to the hot molten metal. Thus, it is desirable not only to initially apply the refractory material evenly, but also to have the option of applying the material in a manner that permits application at such resulting fault points for repair purposes. In this way, any chipping or faulting may be repaired before it causes too much damage.

The most common method of spraying refractory material is by the use of hand-held apparatus. In order to effectuate the spraying process an operator must actually enter the vessel. With such apparatus, however, this method has the disadvantage of requiring a long period of time for the vessel to cool to a safe temperature, which cooling time is unproductive, costly, and undesirable for the industry. Moreover, vessels that are used to transport molten metal in the mill are usually transported with overhead cranes; a certain amount of crane time is required to move the vessel to a remote spot where it can cool before it is sprayed. Since crane time is expensive, it is undesirable to spray vessels in such remote locations. Therefore, there is a need for an apparatus that can spray vessels while they are at or near their operating position, and while they are still hot.

The devices disclosed in U.S. Pat. No. 3,797,745, issued to Haus on Mar. 19, 1974 (hereinafter "Haus"), and in U.S. Pat. No. 3,799,445, issued to Marino on Mar. 26, 1974 (hereinafter "Marino"), purportedly eliminate some of the problems associated with hand spraying. The apparatus disclosed in Marino is particularly suitable for spraying large stationary bodies (col. 1, 11. 5–15), such as furnaces, but is not designed for smaller deep-walled vessels.

The apparatus disclosed in the Haus patent is suitable for spraying smaller refractory bodies. It utilizes a fixed upper element and a rotating bottom element, to which rotating element are attached two fixed, diametrically opposed outwardly-projecting spray nozzles. The fixed nozzles are used to coat the interior sides of the body by simultaneous delivery of refractory spray therefrom. However, the fixed opposing nozzles cannot be positioned to alter the direction of spraying of the refractory material. A separate operation is required by Haus to spray the bottom surface of the vessel, which requires tilting the entire apparatus. (Col. 4, 11. 62–67.) Tilting the apparatus is disadvantageous not only because it comprises an additional step and is per se difficult to accomplish, but also because effecting even spraying of the bottom of the vessel by such a technique is extremely difficult, as it requires the even application of the material through different degrees of tilt of the apparatus without any overlap of the sequentially applied layers of material.

Another disadvantage of Haus is that the discharge of refractory spray from the two nozzles precludes concentrating spray at only one particular defect point for specialized repair application purposes. For example, if one attempted to selectively spray a small defect located on one side wall of a refractory body with the Haus device, refractory spray would also be deposited on the side of the vessel opposite the defect, since the two nozzles of Haus simultaneously spray in opposite directions. This would cause an excess of material to be deposited on the opposite side of the vessel, which point would then be susceptible to chipping and faulting through to the underlying surface, thereby resulting in the creation of another defect as the result of the initial repair. Since defect points in a body therefore cannot effectively be repaired with the Haus apparatus, the interior surface may be susceptible to rapid deterioration.

Thus, there is a need in the art for a refractory spraying apparatus and method that can evenly spray all of the interior surfaces of refractory bodies, including deep-walled vessels. The device must be portable, usable in a vessel substantially above room temperature, and, in addition to having the capability of spraying all portions of the vessel evenly, must also have the capability of directing refractory material at a specific defect or fault point.

OBJECTS AND SUMMARY OF THE INVENTION

It is an object of this invention to provide a refractory spraying apparatus that is portable, economical to operate, and suitable for spraying refractory material on the interior surfaces of deep-walled refractory bodies.

It is a further object of the invention to provide a device that can be used to evenly spray the interior surfaces of such refractory bodies while they are still at or near their operating temperatures.

It is a further object of the invention to provide a device that can be used to direct refractory material at specific defect or fault points of the refractory coatings of refractory bodies.

These objects are accomplished by an apparatus which consists of a fixed top element and a rotating bottom element, rotatably mounted vertically below said fixed top element, that rotates in either direction about the vertical axis of the apparatus. The top element of the apparatus does not rotate with respect to the vessel to be sprayed and is provided with means to suspend and transport the entire apparatus as, for example, by crane. A downwardly-depending adjustable spray nozzle for spraying refractory material is mounted on the lowermost face of the bottom element.

The refractory material is conveyed through an upper conduit which is connected at its top end to a supply of refractory material. The upper refractory conduit runs downwardly through the fixed top element along the vertical axis or centerline of the apparatus, and is connected to a rotary coupling mounted in the fixed element of the apparatus. A corresponding lower refractory conduit passes downwardly from the coupling along the vertical axis of the device into the bottom rotating element of the device.

This rotary coupling is mounted in the fixed top element of the apparatus, above the boundary with the rotating element, is radially centered about the vertical axis, and is constructed to facilitate the passage of any number of air, fluid or refractory conduits from the fixed top portion of the device to the bottom rotating element.

The bottom rotating element is connected to the top fixed element so that it can be rotated in either direction about the vertical axis or centerline of the apparatus, and means are provided to rotate the bottom element.

In one specific embodiment, the rotation of the bottom element is powered by a geared air motor, and a chain drive is used to transfer power from the motor to the rotating element. The use of an air motor is a particular advantage since pressurized air is customarily readily available where refractory material is being sprayed.

The lower refractory conduit continues downwardly in the rotating element and is connected to a downwardly-depending adjustable spray nozzle mounted on the bottom face of the rotating element. The nozzle is angularly positionable to direct refractory material through a 90° arc bounded by a line running through the base of the nozzle perpendicular to the vertical axis of the apparatus and the vertical axis or centerline of the apparatus. The angular direction of spray of the nozzle may be controlled by any suitable means, including but not limited to mechanical, hydraulic, or electrical means.

In one specific embodiment, the adjustable spraying nozzle is constructed of flexible tubular material, and the direction of spray of the nozzle is controlled by a pneumatic power cylinder, the piston end of which is connected to the nozzle while the opposite or barrel end is connected to the rotating bottom element. In this embodiment, the pressurized air, necessary to power the pneumatic cylinder, is supplied to the cylinder by a pressurized air conduit. An upper air conduit is connected to an external supply of pressurized air, enters the fixed top element of the apparatus, runs vertically downward parallel to the axis and is connected to the rotary coupling. The lower air conduit continues downwardly in the rotating portion of the device from the coupling, and is connected to the pneumatic power cylinder. By adjusting the pressure in the air conduit, and thus the pressure in the pneumatic cylinder, the direction of spray of the nozzle can be controlled.

In one specific embodiment, a refractory material is mixed and sprayed with a wetting agent for ease of application. An additional separate conduit is used to convey a wetting agent, the upper end of which is connected to a wetting agent supply, enters the fixed top element of the device, and runs vertically downward parallel to the axis of the apparatus and is connected to the rotary coupling. A corresponding lower wetting agent conduit continues downwardly from the coupling into the rotating portion of the apparatus, and is connected to a mixing chamber, located near the end of the spray nozzle, where the air-conveyed refractory material and wetting agent are mixed just prior to spraying. The mixing chamber is constructed of any material suitable for confining refractory material and whatever wetting agent is used during mixing.

The spraying of a refractory body is begun by lowering the apparatus into the vessel to be sprayed. Refractory material is then sprayed from the adjustable nozzle mounted on the bottom rotating element, the nozzle is adjusted, the bottom element rotated, and the entire apparatus moved throughout the vessel so that all of the interior surfaces of the vessel are evenly sprayed with refractory material. This operation may be interrupted at any time to selectively concentrate spray at any defect area in the vessel.

In a specific embodiment, the apparatus is lowered into the lower portion of the vessel, so that the bottom may be sprayed. Initially, the spray nozzle is directed in a vertical, or "straight down", position, while the bottom element of the device is rotated and spraying is effected. The nozzle is adjusted to gradually raise to a position where it directs its spray perpendicular to the vertical axis of the vessel. By this time the interior bottom surface, including the interior corners of the vessel, is uniformly covered with refractory material. In order to evenly spray the entire interior surface of the vessel, the apparatus is then gradually raised throughout the length of the vessel, while the bottom element is rotated with the nozzle spraying in the horizontal direction.

In another specific embodiment, a control panel is provided for operation of the apparatus of the invention that is conveniently mounted outside the refractory vessel to be sprayed. This panel is mounted in a position so that the operator can view the spraying in the vessel while in progress. From that panel, an operator can control the speed of rotation of the apparatus, the rate of flow of the refractory material and of the wetting agent, the height of the apparatus in the vessel, and finally, the pressure on the pneumatic cylinder, and thus, the direction of spray of the spray nozzle. In this way, the operator may adjust these parameters to insure an even, uniform coating of refractory material throughout the interior surfaces of the vessel. Alternatively, these parameters can be controlled by automated means, such as a properly programmed means with sensing means, so that no human operator would be required to complete the process of evenly coating the interior surface of the vessel.

A defect may be corrected by stopping the rotation of the bottom element, and adjusting the spray nozzle to direct spray at the defect point in the vessel. The operator may continue spraying the point as long as necessary to effectuate repair, and may slowly reciprocally rotate the bottom element, adjust the angular position of the nozzle or move the device through the vessel, to cover a wider area. When the correction of the defect is accomplished, the regular operation of the spraying process may be continued. It should also be noted that the apparatus may be used only for the correction of defects in the event that an even spraying of refractory material is not required for a particular vessel.

Other objects and advantages of this invention will become apparent to those skilled in the art from the detailed description of the invention which follows taken in conjunction with the drawings.

DESCRIPTION OF THE DRAWINGS

FIG. 1 is a side view of a refractory vessel broken away to show the apparatus of the invention in position to effectuate spraying;

FIG. 2 is a vertical cross-sectional view of the rotary coupling shown in FIG. 3; and FIG. 3 is a vertical cross-sectional view of the apparatus of the invention of FIG. 1.

DESCRIPTION OF THE PREFERRED EMBODIMENT OF THE INVENTION

In FIG. 1, the apparatus for spraying refractory material 1 is shown generally as it appears during the operation of spraying a deep-walled refractory vessel 2 with a coating of refractory material 42. The apparatus is supported over the vessel by a chain 3, attached to a crane commonly found in metal fabrication facilities.

A vertical cross-sectional view of the spraying apparatus 1 is shown in FIG. 3. The apparatus comprises a fixed, non-rotating top element 4 and a bottom, rotating element 5, on which is mounted a flexible, downwardly-depending spray nozzle shown generally as 6. The bottom rotating element 5 rotates about the axis of the device in the direction as shown 43, and is supported by supporting arms 41. There are three equilaterally spaced supporting arms 41 radially extending from the lower refractory material conduit **10*b* to the interior surface of the bottom element 5. It should be noted that these supporting arms are separate from the mechanical arm 21, further explained below. Power to rotate the bottom element is provided by an air motor 7, which is connected by conduit 36 to a supply of compressed air 23. Motor speed is reduced through a gear box 8, and power is transferred to the rotating element 5 by means of a gear chain drive assembly 9. The assembly and bottom element are supported and stabilized by a rotatable plate 37 resting on the top plate 38, which comprises the bottom of fixed top element 4**.

Refractory material is air-conveyed to the flexible nozzle 6 by a central conduit having an upper segment **10*a* and a lower segment 10*b*. The top of the upper refractory material conduit 10*a* is connected to a refractory supply 11. The bottom end of the upper segment 10*a* connected to rotary coupling 14. The rotary coupling is shown in FIG. 2, and will be more thoroughly discussed below. The lower refractory material conduit 10*b*, which rotates with and helps stabilize rotating bottom element 5, is connected at its top end to rotary coupling 14 and at its bottom end to nozzle 6. A wetting agent such as water is conveyed to nozzle 6 by means of a conduit having an upper segment 12*a* and a lower segment 12*b*. The top end of upper wetting agent conduit 12*a* is connected to external wetting agent supply 13 and the bottom end is connected to the rotary coupling 14. The top end of lower wetting agent conduit 12*b* is connected to the rotary coupling 14, and its bottom end is connected to mixing chamber 16, where the refractory material and wetting agent are mixed just before spraying through nozzle tip 17**.

The direction of spray of nozzle tip 17 is controlled by way of pneumatic power cylinder 18. The piston end 19 of cylinder 18 is fastened to nozzle 6, and the other or the barrel end 20 is connected to a mechanical arm 21, which is fastened by suitable means, e.g., by welding, to lower refractory material conduit **10*b*. Mechanical arm 21 is separate and distinct from supporting arms 41. The cylinder is powered by a conduit of compressed air having an upper segment 22*a* and a lower segment 22*b*. Segment 22*a* is connected at its top end to a supply of compressed air 23, and passes downwardly such that its bottom end is connected to the rotary coupling 14. The top end of lower air conduit 22*b* is connected to rotary coupling 14, and its bottom end is connected to power cylinder 18. The spray nozzle 6 is shown in FIG. 3 is adjusted to its horizontal position, in which it directs refractory material in a direction parallel to bottom plate 38 of upper element 4. This is the position that would be used to spray the sides of the interior surface of a refractory body. By adjusting the air pressure on pneumatic cylinder 18**, the spray nozzle can be positioned anywhere between the horizontal and the vertical downward position, and therefore can spray anywhere through a 90° arc bounded by a line running through the base of the nozzle perpendicular to the vertical axis or centerline of the apparatus and the axis of the apparatus. As a result of positioning of the nozzle and the rotating of the bottom element, the refractory spray may thus be directed downwardly and/or outwardly anywhere in a hemisphere bounded by a plane running through the base of the nozzle and perpendicular to the vertical axis of the apparatus.

A cross-sectional view of the rotary coupling 14 is shown in FIG. 2. The coupling is designed to permit the flow of a wetting agent from upper conduit **12*a* mounted in the fixed portion of the apparatus through to lower conduit 12*b*, which is mounted so as to rotate with rotating portion 5 of the apparatus; the flow of a refractory material from upper conduit 10*a* mounted in the fixed portion of the apparatus through to lower conduit 10*b*, which is mounted so as to rotate with rotating portion 5 of the apparatus, and the flow of air from upper conduit 22*a* mounted in the fixed portion of the apparatus through to lower conduit 22*b*, which is mounted so as to rotate with rotating portion 5** of the apparatus.

The entire coupling is held together by bolts 24 and 25, and comprises six sandwiched plates: supporting plate 26 (which is integrally connected to the fixed top element 4); rotating steel flange 27; rubber sealing plate 28; steel water and air ring 29; fixed steel flange 30; and clamping ring 31. In steel water and air ring 29 two concentric annular grooves 32, 33 are cut to which are respectively attached the upper segments of the air and wetting agent conduits **12*a* and 22*a*. Corresponding holes are cut into rotating steel flange 27 and rubber sealing plate 28. Lower air and wetting agent conduits 12*b*, 22*b* are connected respectively to the holes in the rotating steel flange 27. The lower refractory material conduit 10*b* is welded to rotating steel flange 27, and is connected to upper refractory material conduit 10*a* by a concentric rotatable bearing 15. Rubber sealing plate 28 rotates with steel flange 27 and is connected thereto by any suitable means, as for example, by a securing pin 40, and has holes corresponding to those in the steel flange 27. The entire assembly rests on a supporting plate 26, which is provided with a circumferential bearing 39 to facilitate the rotation of the steel flange 27. Pressure is maintained on the rubber sealing plate 28 by bolts 24 and 25, which run through supporting plate 26 and a clamping ring 31, and are provided with compression springs 34 and 35**.

In operation, the apparatus is lowered into a refractory body 2, and spray nozzle 6 is directed, by adjusting the air pressure in air conduit 22*a*/22*b* on pneumatic cylinder 18, in the "straight down", or vertical position. Refractory material is forced through central refractory conduit 10*a*/10*b* to the nozzle, and the wetting agent is supplied by conduit 12*a*/12*b* connected to mixing chamber 16; the refractory material and wetting agent are mixed there and sprayed through the tip 17 of the nozzle 6 onto the bottom of the refractory vessel. The pressure on pneumatic cylinder 18 is adjusted by appropriate means to gradually raise the nozzle 6 to the horizontal position and the bottom portion 5 of the apparatus is rotated by actuating the air motor 7. In this way, the entire bottom of the vessel may be evenly covered with refractory material. The apparatus is then gradually raised throughout the vessel with the bottom portion still rotating, so that the sides of the vessel may also be evenly sprayed with refractory material.

In a specific embodiment, a platform with a control panel (not shown on drawings) is provided for an operator to view the spraying in progress in the vessel.

During spraying, it should be understood that the operation can be temporarily interrupted to facilitate the specialized repair application of refractory material at one or more defect points. This specialized application is accomplished by reciprocally rotating the bottom element, adjusting the angular position of the spray nozzle, and moving the entire apparatus to concentrate spray at a particular point or area.

The particular embodiments of the refractory spraying device of the present invention has been described above. To one skilled in the art, however, it will be appreciated that modifications in the method and apparatus can be made, while still accomplishing the desirable aspects of this invention.

What is claimed is:

1. An apparatus for spraying refractory materials on the interior surfaces of refractory bodies, comprising:

a. a fixed top element;

b. a rotating bottom element depending from and rotatably mounted vertically below said fixed element;

c. first means for axially rotating said bottom element about the vertical axis of the apparatus;

d. a downwardly-depending angularly adjustable spray nozzle mounted on the bottom face of said rotating element for spraying refractory material, said nozzle capable of spraying the bottom interior surface of the refractory body;

e. second means for conveying refractory material to said nozzle;

f. third means for conveying a wetting agent to said nozzle; and g. fourth means for adjusting the direction of spray of said nozzle.

2. The apparatus for spraying refractory material as recited in claim 1, where:

a. said adjustable nozzle for spraying refractory material is constructed of a flexible material.

3. The apparatus for spraying refractory material as recited in claim 1, wherein said second means for conveying refractory material and said third means for conveying a wetting agent comprise:

a. refractory supply means;

b. wetting agent supply means;

c. rotary coupling means, wherein refractory material and a wetting agent may be conveyed from said fixed top element to said rotating bottom element;

d. first elongate conduit means for conveying refractory material from said refractory supply means to said adjustable nozzle, said conduit having an upper segment and a lower segment, the top end of said upper segment being connected to said refractory supply means and the bottom end to said rotary coupling, and the top end of said lower segment being connected to said rotary coupling and the bottom end thereof being connected to said adjustable nozzle;

e. second elongate conduit means for conveying a wetting agent from said wetting agent supply means to said adjustable nozzle, said conduit having an upper segment and a lower segment, the top end of said upper segment being connected to said wetting agent supply means and the bottom end connected to said rotary coupling, and the top end of said lower segment being connected to said rotary coupling and the bottom end thereof being connected to said adjustable nozzle.

4. The apparatus for spraying refractory material, as recited in claim 1, wherein said fourth means for adjusting the direction of spray of said nozzle comprises:

a. elongate power cylinder means, designed to apply force in a linear direction, having two ends, one end attached to the rotating element, and the other end to the spray nozzle to effectuate angular adjustment of the direction of spray of said nozzle;

b. pressurized air supply means to power said cylinder;

c. rotary coupling means, wherein pressurized air may be conveyed from said fixed top element to said rotating bottom element;

d. elongate conduit means for conveying said pressurized air, said conduit having an upper segment and a lower segment, the top end of said upper segment being connected to said pressurized air supply means and the bottom end thereof being further connected to said rotary coupling means, and the top end of said lower segment being connected to said rotary coupling means, the bottom end thereof being further connected to said power cylinder means, wherein the flow of pressurized air may be transferred from said supply means through said fixed top element to said power cylinder means.

5. The apparatus of claim 1 wherein the said direction of spray of said nozzle includes any direction in the 90° arc bounded by a line running through the base of said nozzle perpendicular to the vertical axis of said apparatus and the axis of said apparatus.

6. A method for spraying refractory material on the interior surfaces of a refractory body, comprising:

a. placing a refractory spraying apparatus into said refractory body, said apparatus having a fixed top element and a rotating bottom element, on the lower surface of which bottom element is mounted a downwardly-depending, angularly adjustable refractory material spray nozzle, said nozzle capable of spraying the bottom interior surface of the refractory body;

b. spraying refractory material from said nozzle; and c. moving said device through the interior of said refractory body, while rotating said bottom element and adjusting the angular position of said nozzle so as to evenly spray the interior surfaces of said refractory body with refractory material.

7. The method of claim 6, wherein the refractory material is sprayed from a nozzle constructed with a flexible material.

8. The method of claim 6, further comprising:

a. temporarily concentrating refractory material at a specific area in the interior surface of said refractory body by moving said device through the interior of said refractory body, rotating the bottom element, and adjusting the angular position of said nozzle to effect spraying at such area.

* * * * *